United States Patent [19]

Perry

[11] Patent Number: 4,515,110

[45] Date of Patent: May 7, 1985

[54] ROD BEARING LUBRICATION FOR TWO-CYCLE ENGINES

[76] Inventor: John C. Perry, 3170 Falcon Dr., Carlsbad, Calif. 92008

[21] Appl. No.: 633,471

[22] Filed: Jul. 23, 1984

[51] Int. Cl.[3] ..... F01P 1/04

[52] U.S. Cl. ..... 123/41.37; 123/41.34; 123/73 AD; 123/196 AB; 123/196 R; 123/DIG. 3; 184/24; 184/27 R

[58] Field of Search ..... 123/196 R, 196 AB, 41.37, 123/41.34, 73 AD, DIG. 3; 184/24, 27 R

[56] References Cited

U.S. PATENT DOCUMENTS

| | | | |
|---|---|---|---|
| 634,529 | 10/1899 | Lee | 123/196 R |
| 1,907,805 | 5/1933 | Heintz | 123/73 A |
| 2,056,901 | 10/1936 | Kylen | 184/6.5 |
| 2,280,296 | 4/1942 | Mantle | 184/6.5 |
| 2,449,657 | 9/1948 | Kishline | 123/41.37 |
| 2,899,016 | 8/1959 | Swayze | 184/6.5 |
| 2,936,748 | 5/1960 | Jensen | 123/196 CP |
| 2,983,334 | 5/1961 | Dalrymple | 123/196 CP |
| 3,119,380 | 1/1964 | Armstrong | 123/DIG. 3 |
| 3,396,819 | 8/1968 | Baxter et al. | 184/6.5 |
| 3,656,582 | 4/1972 | Alcock | 184/24 |

*Primary Examiner*—E. Rollins Cross
*Attorney, Agent, or Firm*—Robert G. Upton

[57] ABSTRACT

This invention is a lubrication pumping means contained within one or more reciprocating rods to assure lubrication of the crankpin rod bearing and the wrist pin bearing during operation of a two-cycle internal combustion engine. The invention teaches a means to collect and retain a column of lubricating fluid within a longitudinal bore formed in the rod.

15 Claims, 7 Drawing Figures

ROD BEARING LUBRICATION FOR TWO-CYCLE ENGINES

This application is related to a co-pending application Ser. No. 555,194, filed in the Patent Office Nov. 25, 1983, entitled LUBRICATION MEANS FOR A TWO-CYCLE INTERNAL COMBUSTION ENGINE.

BACKGROUND OF THE INVENTION

1. Field of the Invention

This invention relates to a lubrication means for an internal combustion engine.

More particularly, this invention relates to a lubrication pumping apparatus actuated by one or more reciprocating piston rods to assure lubrication of the crankpin bearing and the wrist pin bearing of an internal combustion engine.

2. Description of the Prior Art

Many different ways to lubricate the various rotating parts of an internal combustion engine are well-known in the art. For example, with internal combustion engines having oil reservoir sumps, lubricating holes are provided in the rod cap of a piston rod to supply lubricant to the rod crankpin bearing of the crankshaft during operation of the engine. These passages typically are transverse to an axis of the crankpin. The openings may be holes drilled through the rod bearing cap or a slot may be provided at the bottom of the rod cap to allow lubricant to pass into the crankpin bearing areas. This method is sufficient to lubricate the rod crankpin bearing where oil in the sump submerges the crankshaft/-crankpin as the crankshaft revolves within the engine crankcase or engine block.

There are other methods that force lubricant from a pump within an oil sump of an internal combustion engine to various bearing surfaces. For example, oil is forced through a borehole in the crankshaft into the rod crankpin bearing. These types of engines typically have a motor-driven oil pump that supplies lubricant under pressure to all the bearings.

U.S. Pat. No. 2,280,296 teaches a means to lubricate a rod/crankpin bearing by providing a series of spiral lubricating grooves down the bearing surfaces of a crankshaft that terminates at the crankshaft flywheel. A port, directed from the spiral lubricating grooves through the crankpin to the interior of the bearing surfaces formed between the crankpin and the rod cap, provides a lubricating path to this bearing, thus providing lubricant to the bearing during operation of the engine. Lubricant is drawn from a sump at the bottom of the crankcase, up the front of the engine to the forward end of the crankshaft and, from there, down the spiral grooves in the crankshaft to the rod/bearing crankpin. While a means is provided to pump lubricant to a rod/crankpin bearing, there is no means to lubricate the wrist pin connecting the rod to the piston.

U.S. Pat. No. 2,936,748 describes a means for lubricating a two-cycle engine. This invention provides a means to collect oil droplets that separate from a fuel-/oil mixture and directs this separated and collected oil to bearing surfaces within the engine. These two-cycle engines depend for their lubrication upon the collection of oil entrained in the stream of gaseous fuel charge (fuel/oil mixture) whereby the lubricant may be selectively directed to critical lubricating points. This patent teaches the utilization of a pressurized lubrication system for two-stroke engines. Collected oil is routed, under pressure, from a crankcase of the engine and is forced into a chamber formed in the crankshaft and, from there, to a port leading from the crankshaft to the rod/crankpin bearings, thus feeding this collected lubricant, separated from the fuel, to this particular bearing.

This patent provides an oil separation system and a separate pump within the crankcase to direct the separated and collected oil to various bearing surfaces, such as the bearing of the crankshaft and the rod/crankpin bearing. There is, however, no means to direct lubricant to the wrist pin bearing.

The present invention goes beyond the state of the art in that a lubricant pumping means is provided by utilizing the reciprocating and circular motion of the piston rod to collect and drive lubricant entrained in a fuel/oil mixture within the crankcase of a two-cycle engine to the crankpin and wrist pin bearings. When the piston moves up its cylinder wall, a partial vacuum is created within the crankcase which draws a mixture of fuel and lubricant into the crankcase chamber. The rod connected between the crankpin of the engine crankshaft and the wrist pin of the piston forms an internal passage or longitudinal bore that communicates between the crankpin rod bearing and the wrist pin rod bearing. A fuel/oil rod inlet opening or slot is positioned between the crankpin and the wrist pin. The inlet slot is preferably positioned in the bottom one-third of the rod nearest the crankpin bearing and is oriented parallel to the shank of the rod. The slot intersects the bore in the rod and communicates between the interior of the crankcase chamber and the interior passage in the rod. Again, as the piston moves up the cylinder, the partial vacuum created within the chamber draws a mixture of fuel and oil into the chamber and, from there, into the inlet slot in the side of the rod transverse to the longitudinal bore in the rod shank. Fuel and oil is "scooped" into the interior of the rod as the rod revolves around the crankshaft flywheel. When the rod rotates clockwise from about the three o'clock position to about the nine o'-clock position, fuel is scooped into the inlet slot to the rod interior. As the engine is operating, the interior of the rod eventually fills with lubricant, thus assuring a means to lubricate both the crankpin bearing and the wrist pin bearing from within the interior of the rod while maintaining the temperature of the rod within a safe range (especially during high RPM conditions) to prevent potential catastrophic failure of the rod. A protrusion formed by the rod at an exit end of the opening or slot within the internal bore diverts the lubricant within the rod around the opening, thus substantially preventing the lubricant from exiting the interior of the rod. Inertial forces generated by the reciprocating piston drives fuel and oil contained within the bore in the rod into the crankpin and wrist pin bearing surfaces under high pressure during engine operation.

An alternative embodiment of the present invention consists of a rod with a longitudinal bore through the center of the rod. A pair of fuel and oil inlet ports are positioned in the face of the rod in axial alignment with the wrist pin and the crankpin of the rod. The fuel and oil passage ports are positioned on one or both faces of the rod as opposed to a passage port on a side of the rod as previously described. The fuel and oil inlet ports on one or both sides of the rod communicate between the crankcase chamber and the internal longitudinal bore in the rod. The ports are preferably positioned about halfway between the wrist pin and the crankpin. The ports through a face of the rod are additionally angled from the outside face of the rod toward the crankpin end and toward the wrist pin end of the rod. The angle of the inlet ports is between fifteen and forty-five degrees. A scoop is also provided above and below the inlet ports on the face of the rod to provide a means to collect fuel and oil entrained within the crankcase and on the surface faces of the rod as the crankpin moves through each revolution. By positioning the inlet ports on one or both faces of the rod—the dual passageways being in alignment with the crankpin or the wrist pin—as the rod rotates and reciprocates within the engine, the lubricant within the longitudinally extending bore in the rod cannot, for example, readily escape through a port positioned in the side of the rod as is taught in the other embodiment of this invention.

Insofar as the inventor is aware, no one has utilized the reciprocating and circular motion of a rod/piston combination to direct lubricant into the interior of a rod to lubricate and cool the crankpin and the wrist pin bearings from within a cavity formed in the rod. These types of bearings are especially subjected to intense heat and frictional loads which, in turn, may catastrophically fail these bearing surfaces under extreme conditions without adequate lubrication and cooling. For example, miniature two-cycle engines typically used in model boats and aircraft are capable of operating in a revolution per minute range between 2,000 and 30,000 RPM's. These types of engines are especially vulnerable to rod failure when operating at high RPM's due to intense heat and sparse lubrication.

SUMMARY OF THE INVENTION

It is an object of this invention to provide a means to lubricate and cool crankpin and wrist pin rod bearings of a two-cycle internal combustion engine. The rod bearings are lubricated by directing lubricant into a central, longitudinally extending cavity formed in the rod that communicates between the crankpin bearing and the wrist pin bearing through an opening in the rod oriented about 90° to the longitudinal bore in the rod. The opening or passageway opens into the internal cavity in the rod. The intersecting opening is exposed to the internal chamber formed by the crankcase of the engine. A mixture of fuel and oil is directed to the interior cavity of the rod from the chamber in the crankcase. The partial vacuum caused by a piston moving in a cylinder away from the crankcase housing draws a supply of fuel and oil from a fuel supply source into the crankcase housing and, from there, the mixture is scooped into the longitudinally extending bore formed within the rod through the intersecting opening or passage between the crankcase chamber and the bore in the rod.

A method to lubricate and cool a piston rod and rod bearings is disclosed. The rod is connected between a crankpin of a crankshaft and a wrist pin secured to a piston for a two-cycle internal combustion engine. A longitudinally extending bore is formed within the rod. The bore communicates between the crankpin at a first end of the rod and the wrist pin at a second end of the rod. An interconnecting passage means is formed in the rod that communicates between the longitudinally extending bore and a crankcase chamber formed by and within an engine block of the two-cycle engine. The passage has a first inlet end and a second exit end. The rod forms a protrusion at the second exit end of the passage within the longitudinal bore.

A combustible mixture of fuel and oil is injected within the crankcase chamber from a source of fuel and oil communicating with the chamber. A mixture of fuel and oil entrained within the chamber is collected through the interconnecting passage in the rod communicating between the longitudinally extending bore in the rod and the chamber. The fuel and oil enter the bore in the rod and exits through a crankpin rod bearing and a wrist pin rod bearing as the rod reciprocates with the piston and rotates around the crankshaft through the crankpin. The protrusion formed by the interconnecting passage means serves to divert the collection of fuel and oil around the passage means to inhibit the fuel and oil from exiting the passage means; the fuel and oil thereby lubricating the bearings and cooling the rod as the engine operates.

The intersecting passageway or opening in the side of the rod is positioned between the crankpin bearing and the wrist pin bearing in about the bottom one-third of the rod near the crankpin bearing. The opening is formed in one side of the rod into the longitudinal bore formed in the rod. As the rod moves in a circular motion from one side of the engine housing to the other side of the engine housing (as the crankshaft rotates the crankpin within the engine housing), the mixture of fuel and lubricant is scooped into an entrance opening and directed to the interior bore in the rod as the crankpin end of the rod, for example, moves clockwise from side to side from about a three o'clock position to about a nine o'clock position during reciprocation of the piston within its cylinder during operation of the two-cycle engine.

In another embodiment, dual passageways communicating between the crankcase chamber and the internal bore of the rod are positioned on one or both faces of the rod in alignment with the crankpin or wrist pin of the internal combustion engine. By positioning the dual lubrication inlet ports on each face of the rod and angling each of the ports from an outside face of the rod toward the crankpin or wrist pin end of the rod and by providing a ledge or scoop above and below the outside openings or inlet openings to the passageways leading to the bore in the rod, fluid is scooped into the inlet ports into the internal bore in the rod as the rod moves, reciprocates and rotates during engine operation. By positioning inlet ports in the face of the rod; as opposed to positioning the inlet port in a side of the rod; as the rod rotates and reciprocates within the internal combustion engine, fluid trapped or entrained within the bore of the rod is less likely to be ejected from the internal bore of the rod during its rotational movement.

An advantage over the prior art is the positioning of a lubricant supply means within the rod to supply the crankpin bearing and the wrist pin bearing with lubricant from within the confines of the rod body to assure cooling of the rod and lubrication of the crankpin and the wrist pin bearings.

Another advantage over the prior art is the means in which lubricant is directed into the hollow interior of the piston rod by utilizing the circular motion of the crankpin end of the rod to scoop in fluid within the engine crankcase to the inside bore or chamber in the rod to assure lubrication of the crankpin and the wrist pin bearings.

Yet another advantage of the present invention over the prior art is the addition of a protrusion or knob formed by the rod body at an exit end of the passageway formed in the rod between the crankcase chamber and the longitudinally extending bore formed in the rod. The protrusion within the bore of the rod serves to substantially prevent the lubricant entrained within the rod from exiting the rod during engine operation by diverting the lubricant around the exit end of the passageway as the lubricant traverses the longitudinal bore formed in the rod.

Still another advantage of the present invention over the prior art is the alternative method of providing scoops and inlet ports in a face of the rod as opposed to the side of the rod with the ports oriented generally axially with the crankpin of the engine. As the rod rotates and reciprocates during engine operation, the scoops in one or both faces of the rod pick up lubricant from the crankcase and direct the lubricant through the passageway into the internal bore of the rod. The advantage is that the lubricant entrained within the rod is less likely to escape the rod through the axially oriented passageways. Circular motion could expel liquid from the internal bore of the rod through a passageway positioned in a side of the rod as opposed to a face of the rod.

An obvious advantage of the present invention is the high pressure developed by a column of fluid in motion within the rod when the piston reaches the limit of its reciprocal travel and reverses itself. Obviously this happens at each end of the rod. It is this high pressure lubrication system that deposits a film of oil between the bearing surfaces with sufficient force to assure lubrication of these bearings, thereby greatly extending the life of the crankpin and wrist pin bearings as well as the rod itself. This type of lubrication system is far superior to lubrication methods, used in two-cycle engines whereby bearings are lubricated by a more or less fortuitous encounter with fuel and oil suspended or entrained within the crankcase housing during operation of the engine.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
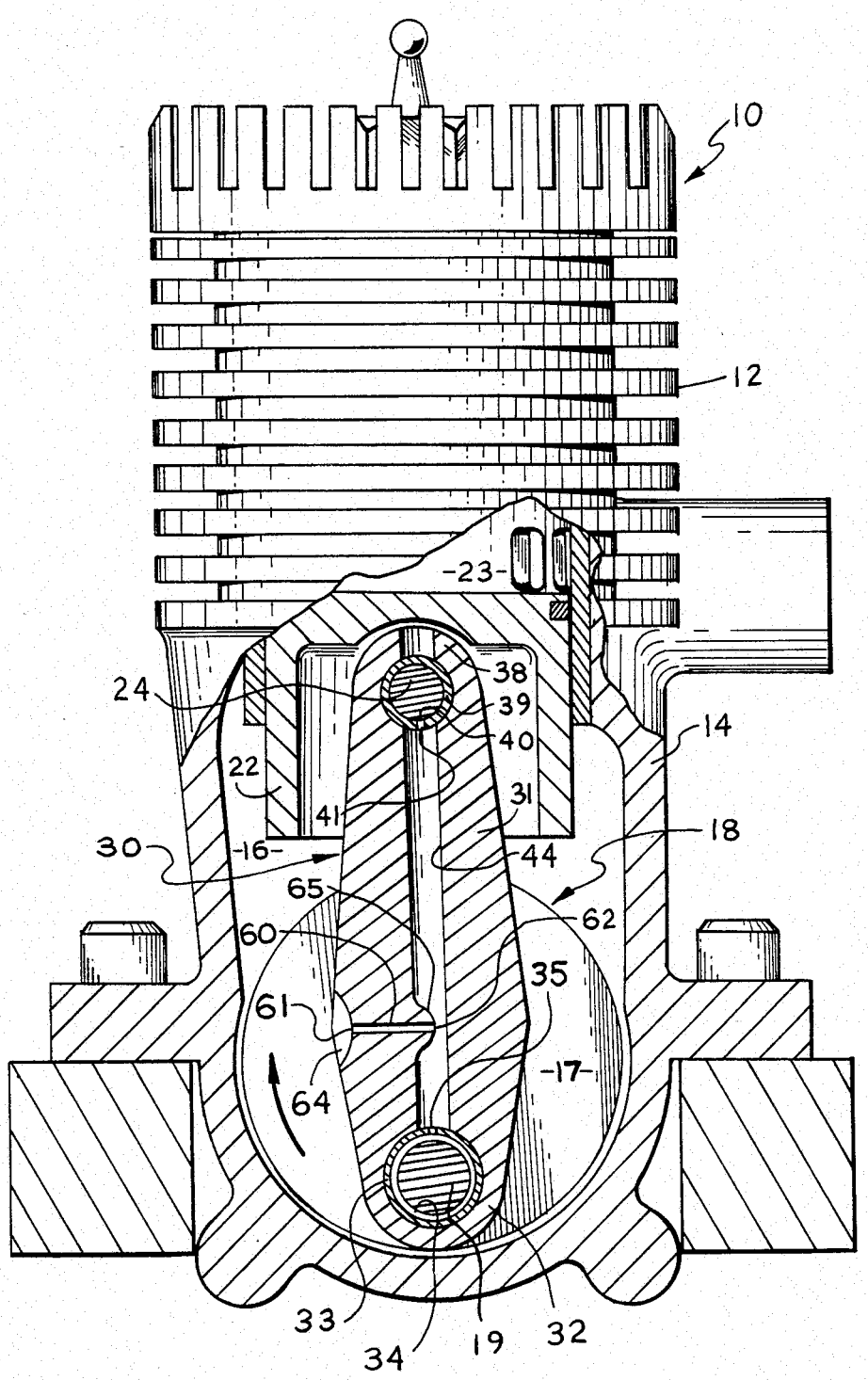
FIG. 1 is a partially cutaway cross section of a typical two-cycle engine, illustrating the rod mechanically linked to the crankshaft and the piston with the means to supply fuel to the bearings at either end of the rod.

With reference now to FIG. 1, the two-cycle engine, generally designated as 10, consists of cylinder head 12, crankcase housing 14, which forms a crankcase chamber 16 thereby. Contained within the crankcase 14 is a crankshaft, generally designated as 18. Contained within the crankcase chamber 16 is flywheel 17, connected to the crankshaft. A crankpin 19 extends from flywheel 17 and connects to a rod, generally designated as 30. A piston 22 is contained within its cylinder 23.

The rod 30 consists of a rod shank 31 and a crankpin end 32. A bronze bushing 33, for example, is pressed into the crankpin end 32 and provides a bearing that mates with crankpin 19 of the crankshaft 18. A circumferential lubrication groove 34 is formed in the bearing wall of the bronze bushing 33. At the opposite end of the rod shank 31 is a wrist pin end 38. Again, a bronze bushing 39 is pressed into the wrist pin end 38. A wrist pin 24 retains piston 22 to end 38 of rod 30. A lubrication slot or groove 40 is provided within the bushing 39 and communicates with a lube access hole 41, centrally positioned within the bushing. The lubrication groove 40 serves to transfer lubricant passing through lube access hole 41 around the bushing to properly lubricate wrist pin 24 retained within the piston 22.

An internal, cylindrical bore 44 is drilled approximately through the center of the rod shank 31 through one end of the rod. The internal, cylindrical bore communicates between the lube access hole 35 in crankpin end 32 and the lube access hole 41 in the wrist pin end 38 of rod 30. The internal bore 44 within the rod shank 31 communicates with the interior chamber 16 formed within crankcase 14 through an access hole or passage 60 that communicates between chamber 16 and the lube hole or bore 44 within shank 31. Since the crankshaft 18, for example, rotates clockwise when viewed from the rear of the engine, the lube access passage 60 is positioned, in this embodiment, on the left side of the rod between rod ends 32 and 38. The passage is located generally in the bottom one-third of the rod nearest rod end 32. The access passage 60 is positioned within a scoop or trough 64 in the side of the rod shank 31. An inlet opening 61 leads into passage 60 and passage 60 terminates at opening 62 which communicates with the bore 44 within the rod shank 31. The rod body 31 forms a protrusion 65 that extends part way into bore 44 and serves to divert a flow of lubricant contained within bore 44 around the protrusion preventing the lubricant from escaping through opening 62 during engine operation. The access passage 60 is about transverse or ninety degrees to the axis of the bore 44 within the rod.

During engine operation, as the crankshaft rotates within the housing 14, the lower portion of the rod swings from about the three o'clock position to about the nine o'clock position and, during this portion of the swing of the rod, fuel and lubricant drawn into the crankcase 16 is scooped into the access passage 60 through scoop or opening 64 in the side of the rod into the internal bore 44 within the rod. Fuel and lubricant now contained within the rod then is forced down the bore 44, through inertial forces, into the crankpin bearing 33 into groove 34 within the bronze bushing and, from there, into the crankpin bearing surfaces of the crankpin 19 when the rod 30 reverses its reciprocal motion, passing through the six o'clock position. As the piston reaches top dead center and starts down its power stroke, a column of lubricant is driven up the bore 44 into the wrist pin 24, under high pressure, through lube access hole 41 in bushing 39, thus providing lubricant to the wrist pin during this portion of the stroke of the piston. The bore within the rod eventually fills completely with fuel and oil, the cavity or bore 44 being continually refilled as the engine continues operation. The protrusion 65 diverts the flow of lubricant, preventing its escape back through passage 60 during engine operation.

It can readily be realized then that the bearing surfaces at opposite ends of the rod 30 are lubricated through a column of lubricant contained within the rod to assure proper lubrication to these critical bearing surfaces during operation of the engine without the aid of complicated pumps or valves to force lubricant into these bearings. The action of the crankpin end 32 of rod 30, moving in a clockwise circular motion from about a three o'clock position to about a nine o'clock position, picks up fuel and lubricant entrained within the crankcase 16 of the engine through scoop 64 into passage 60 and, from there, through exit opening 62 at the apex of protrusion 65 into the bore 44 within the rod. Thus, during at least half to three-quarters of the rotation of the flywheel 17 of the crankshaft 18, fuel entrained in the crankcase is picked up through scoop 64 to continually provide a column of fuel and lubricant to the internal bore of the rod.

The combination of the circular motion of the bottom end of the rod 32 and, more importantly, the inertial forces acting upon the rod shank 31 of rod 30, serves to scoop in and force lubricant and fuel under high pressure to opposite ends of the rod 32 and 38 to both lubricate and cool the crankpin and the wrist pin of the two-cycle internal combustion engine. The circular motion of the rods, combined with the internal pressures within the crankcase of the engine, serves to drive a mixture of fuel and lubricant into the access port 60 to the passage 44 within the rod. The inertial forces exerted on the rod by the piston reciprocating within its cylinder forces the column of lubricant within the rod either into the crankpin or the wrist pin bearing surfaces during operation of the engine. High pressures are generated on the column of liquid when the rod reverses its reciprocal direction.

Figure 2:
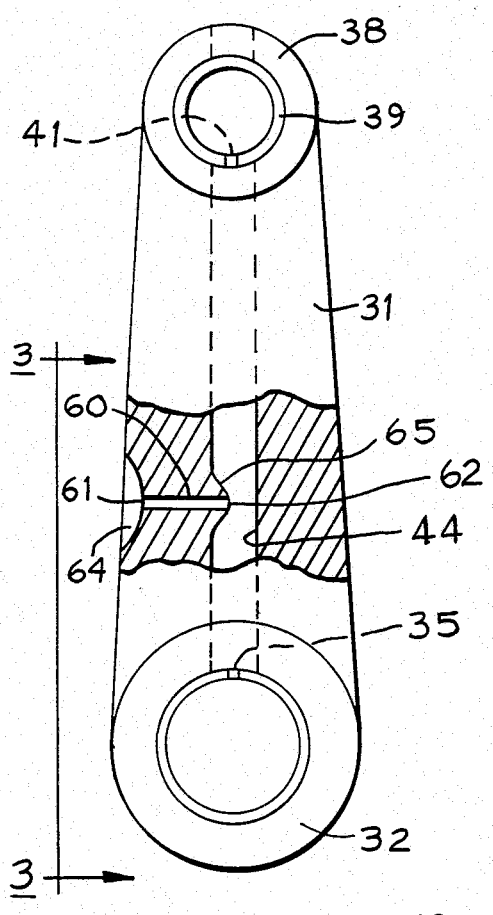
FIG. 2 is a partially cutaway cross section of the rod, illustrating the inlet and exit ports of the passageway in the side of the rod with a protrusion on the inside of the rod.

Turning now to FIG. 2, the rod 30 is shown separated from the engine illustrated in FIG. 1. The longitudinal bore 44 is drilled down through the center of the rod from the wrist pin end 38. Obviously, the bushing 39 is not pressed into the wrist pin end 38 at this time. After the internal bore 44 is drilled in the rod, the bronze wrist pin bearing 39 is pressed into the wrist pin end 38 of the rod. A lubricating port 41 communicates with similar passages formed in the bushing 39 to distribute lubricant to the wrist pin during engine operation. Similarly, bronze crankpin bearing 33 is pressed into end 32 of the rod, the bushing having a lube access hole 35 that communicates with port 44 and the crankpin of the engine. An inlet trough or scoop 44 is formed, in this case, on the left side of the rod that leads to passage 60, communicating between the crankcase and the bore 44. The inlet end 61 of passage 60 directs lubricant through the passage to exit 62 positioned in the apex of protrusion 65, formed in the rod and extending into the bore 44 (see FIG. 4). Again, the protrusion 65 serves to divert a flow of lubricant within bore 44 to substantially prevent escape of lubricant within the bore out of the inlet end 61 of the rod during engine operation.

Figure 3:
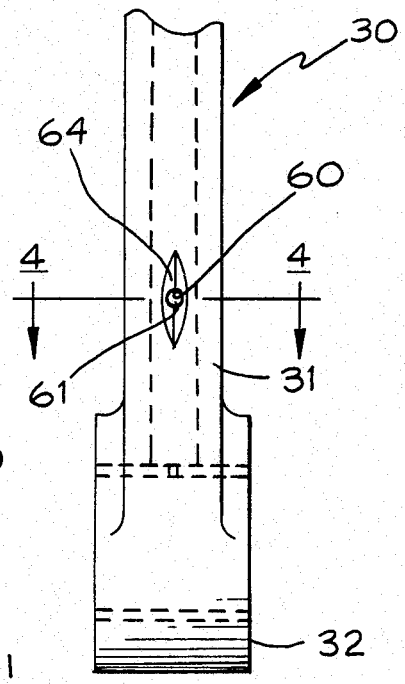
FIG. 3 is a view taken through 3—3 of FIG. 2, illustrating the inlet scoop of the passageway positioned in the side of the rod.

FIG. 3 illustrates the inlet scoop 64 that directs fuel and lubricant into inlet 61 to passageway 60. Obviously, the inlet scoop could be of various configurations. For example, it could be a narrow slot as described and claimed in the related application by the same inventor. The passageway 60 is preferably located in the bottom half to one-third of the rod closest to the crankpin end 32 of the rod.

Figure 4:
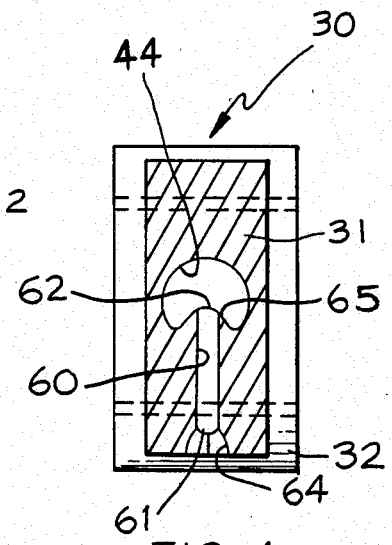
FIG. 4 is a view taken through 4—4 of FIG. 3, showing the flow diverting protrusion formed by the rod at the exit port of the side positioned passageway within the bore of the rod.

The view shown in FIG. 4 illustrates clearly the protrusion 65 that extends within the bore 44 of the rod. Fuel is diverted around the exit end 62 as it traverses back and forth within bore 44 as heretofore described.

Figure 5:
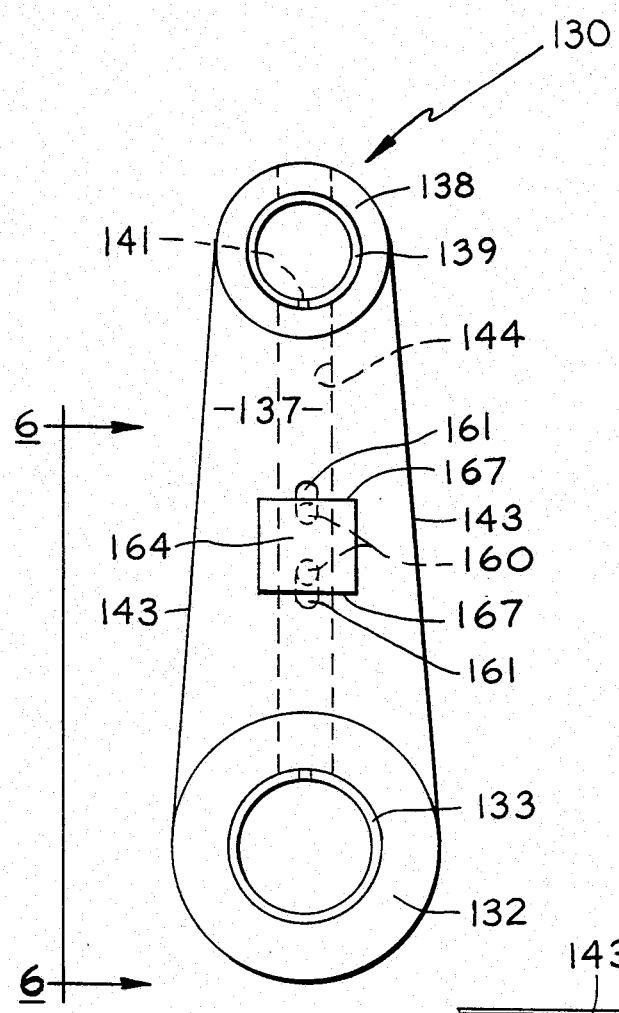
FIG. 5 is a partially cross-sectional rod illustrating an alternative embodiment of the invention wherein one or more passageways are formed in the face of the rod body, the passageways being oriented axially with the crankpin and wrist pin.
Figure 6:
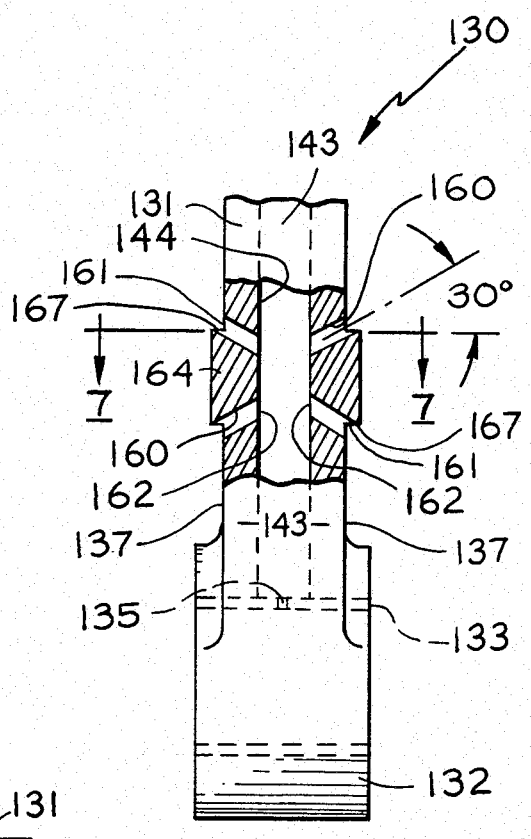
FIG. 6 is a view taken through 6—6 of FIG. 5, illustrating the scoop inlets leading into the angled, axially aligned passageways in each face of the rod as opposed to the passageway in the side of the rod as illustrated in FIGS. 1 through 4.

Referring now to FIG. 5, an alternative embodiment is illustrated wherein a rod, generally designated as 130, consists of rod body 131 that forms a longitudinal bore 144. The bore 144 is drilled from wrist pin end 138 through the center of the rod 131. Wrist pin and crankpin bearing bushings 139 and 133 are pressed into the wrist pin end and crankpin end after the bore 144 is formed in the rod. Lubricant communicating holes 141 and 135 are formed in bearings 139 and 133 to communicate with the bore 144 for passage of lubricant thereby. Dual fuel and lubricant inlet ports 160, for example, are formed on each face of the rod. Fuel inlet ports 161 lead to angled passageways 160 that terminate at separate exit ports 161 within bore 144 of rod 131. Lubricant scoops 164 are formed on both faces of the rod (FIG. 6). The inlet scoops or shelves serve to collect or trap lubricant and fuel on surfaces 167 of scoops 164 as the rod reciprocates and circulates within the two-cycle engine. The inlet ports 161 are drilled in face 167 of scoop 164 to assure a maximum flow of lubricant into the inlet ports 161. The lubricant then passes through passages 160 and out exit ports 162 to the interior 144 of rod 131.

The view illustrated in FIG. 6 more clearly shows the relationship of the dual inlet ports on both faces 137 of the rod 131. The fuel scoops 164 trap lubricant adhering to both faces of the rod as well as fuel and lubricant entrained within the crankcase of the two-cycle engine. The passageways 160 on one face of the rod are, for example, angled about thirty degrees. The upper passageway 160 angles from inlet opening 61 to exit opening 162 toward the crankpin end of the rod 131 while the lower inlet passageway 160 angles from inlet port 161 to exit port 162 toward the wrist pin end of the rod 131—the dual ports being substantially identical on both faces 137 of rod 131. Obviously, the angle of passageways 160 could be other than thirty degrees (anywhere from fifteen to forty-five degrees) without departing from the scope of this invention. The exit ports 162 within bore 144 (a pair on each side of the rod) are separated (two separate exit ports 162 in each side of the bore in the rod). The reason the exit ports 162 are separated is to inhibit the incoming lubricant from passing from one exit port 162 back through the other exit port and out the rod during engine operation.

By positioning the fuel and lubricant passageways in the face 137 of the rod—the ports being oriented axially with the crankpin and the wrist pin—the rod essentially picks up fuel and lubricant through three hundred and sixty degrees of its rotation during engine operation. By providing inlet ports 161 to passageways 160 on opposite faces of a rod through protruding scoops 164, lubricant is picked up and directed to the interior 144 of the rod no matter which way the rod rotates or reciprocates. Hence, a flow of lubricant is assured within the confines of the bore 144 of the rod.

Figure 7:
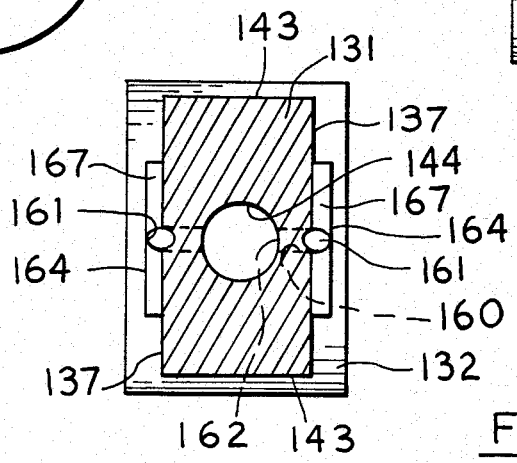
FIG. 7 is a view taken through 7—7 of FIG. 6 showing the fuel and oil inlet scoops formed in each face of the rod, the inlet ports extending out to an edge of each scoop to maximize a flow of lubricant into the longitudinally extending bore in the rod.

FIG. 7 shows the relationship of the inlet ports 161 with respect to the scoop surface 167 formed on scoops 164. Fuel and lubricant is readily directed into the fuel inlet port by positioning the fuel inlet port 161 out to the edge of the scoop surface 167. Lubricant adhering to the rod wall surfaces 137, as well as the globules of fuel and lubricant floating within the crankcase chamber, is readily picked up by this scoop and directed into the passageways 160. By angling each of the passageways as illustrated, lubrication flow is accelerated toward the interior bore 144 during engine operation.

The lubricant entrapped or contained within bore 144 of the rod 131 tends to adhere more readily to opposing surfaces 145 of bore 144, these surfaces being adjacent each side 143 of rod body 131. Since the crankpin end of the rod 132 moves in a circular direction, as well as in a reciprocating direction, lubricant within bore 144 tends to adhere more readily to surfaces 145 in the rod due to the centrifugal force of the circular motion of the bottom end of the rod. Hence, fluid is less likely to be expelled from the interior 144 of the rod 131 through a passageway that may be positioned in sides 143, as opposed to having the passageway positioned in faces 137 of rod body 131.

It would be obvious to utilize just one passageway in each face 137 of rod body 131. It would also be obvious to use a differently shaped scoop 164 to direct lubricant into passageways 160 in each face of the rod without departing from the scope of this invention. Moreover, it is obvious to use multiple passageways in one or more faces of the rod.

It would also be obvious to position the fuel and lubricant inlet passageways 160 and scoop 164 near the wrist pin end 138 or the crankpin end 132.

It would additionally be obvious to position the passage 60 on the right side of the rod shank 31 if the engine should rotate counterclockwise when viewed from the rear (FIGS. 1 through 4). Fuel would then be picked up through inlet scoop 64 from about the nine o'clock position to about the three o'clock position.

This invention therefore uniquely and simply addresses the critical problem of overheating crankpin bearings and wrist pin bearings during high RPM's, typical of two-cycle engines. By feeding lubricant under pressure to these critical bearing surfaces from within the confines of the rod, lubrication is assured to these bearing surfaces, thus preventing catastrophic failure of the rod or the rod bearings during high-speed operation of these types of engines.

This is a particular problem, as heretofore stated, with miniature two-cycle engines which tend to turn at very high RPM's.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A method to lubricate and cool a piston rod and rod bearings, said rod being connected between a crankpin of a crankshaft and a wrist pin secured to a piston for a two-cycle internal combustion engine comprising the steps of:

forming a longitudinally extending bore within said rod, said bore communicates between said crankpin at a first end of said rod and said wrist pin at a second end of said rod, forming an interconnecting passage means in said rod that communicates between said longitudinally extending bore and a crankcase chamber formed by and within an engine block of said two-cycle engine, said passage having a first inlet end and a second exit end, said rod forming a protrusion at said second exit end of said passage within said longitudinal bore, injecting a combustible mixture of fuel and oil within said crankcase chamber from a source of said fuel and oil communicating with said chamber, and collecting said mixture of fuel and oil entrained within said chamber through said interconnecting passage in said rod communicating between said longitudinally extending bore in said rod and said chamber, said fuel and oil enters said bore in said rod and exits through a crankpin rod bearing and a wrist pin rod bearing as said rod reciprocates with said piston and rotates around said crankshaft through said crankpin, said protrusion formed by said rod within said bore at said second exit end of said interconnecting passage means serves to divert said collection of fuel and oil around said passage means to inhibit said fuel and oil from exiting said passage means, said fuel and oil thereby lubricating said bearings and cooling said rod as said engine operates.

2. The method as set forth in claim 1 further comprising the step of scooping said mixture of fuel and oil into said first inlet end of said interconnecting passage means into said interior bore within said rod as said rod rotates with said crankpin of said crankshaft from about the three o'clock position to about a nine o'clock position as said crankshaft rotates clockwise thereby admitting fuel and oil into said bore within said rod to lubricate said crankpin and wrist pin bearings and to cool said rod during engine operation.

3. The method as set forth in claim 2 wherein said passage means communicating between said crankcase chamber and said bore in said rod is located within about the bottom one-third of said rod nearest said crankpin, said passage means is about transverse to the axis of the bore in said rod.

4. The method as set forth in claim 1 further comprising the step of driving a column of said mixture of fuel and oil contained within said longitudinal bore formed in said rod alternately into said crankpin bearing or said wrist pin bearing through an inertial force generated by the reciprocal action of the rod as the piston reciprocates within its cylinder, said column of fuel and oil enters said crankpin bearing or said wrist pin bearing under high pressure as said rod reverses its reciprocal motion during engine operation, said column of fuel and oil is substantially diverted around said protrusion formed by said rod at said second exit end of said passage means thereby substantially preventing said fuel and oil from escaping out of said passage means during engine operation.

5. A method of forming a lubrication passage within a rod to lubricate crankpin and wrist pin bearings for a two-cycle internal combustion engine comprising the steps of:

drilling a longitudinally extending bore in said rod through an end of said rod, said bore communicates with said crankpin bearing and said wrist pin bearing, drilling an intersecting passage in said rod through a side of said rod, said passage forming a first inlet end and a second exit end, said passage being in communication between a crankcase chamber formed in an engine block of said engine and said bore in said rod, an axis of said intersecting passage being oriented about ninety degrees from an axis of said bore in said rod, and forming a protrusion in said rod at said second exit end of said passage, said protrusion extends into said longitudinally extending bore, said protrusion serves to divert a flow of lubricant traversing said bore around said intersecting passage to substantially prevent said lubricant from exiting said passage during operation of said engine.

6. A means to lubricate rod bearing surfaces for a two-cycle internal combustion engine comprising an engine housing forming a crankcase chamber and bearing surfaces for a crankshaft, said crankshaft serves to scoop said entrained fuel and oil within said crankcase chamber into said bore formed in said one or more rods during engine operation.

7. The invention as set forth in claim 6 wherein said two-cycle internal combustion engine is a miniature two-cycle engine.

8. The invention as set forth in claim 7 wherein said miniature two-cycle engine operates in a revolution per minute range of from two thousand RPM's to thirty thousand RPM's.

9. A method to lubricate and cool a piston rod and rod bearings, said rod being connected between a crankpin of a crankshaft and a wrist pin secured to a piston for a two-cycle internal combustion engine comprising the steps of:

forming a longitudinally extending bore within said rod, said bore communicates between said crankpin at a first end of said rod and said wrist pin at a second end of said rod, forming at least one interconnecting passage means in said rod that communicates between said longitudinally extending bore and a crankcase chamber formed by and within an engine block of said two-cycle engine, said passage means being oriented substantially parallel in a first plane to an axis of said crankshaft, said passage having a first inlet end formed in a face of said rod and a second exit end formed in a wall of said bore formed in said rod, said passage means being angled, in a second plane, toward one of said ends of said rod, forming a scoop means in said rod adjacent said first inlet end of said at least one passage means, injecting a combustible mixture of fuel and oil within said crankcase chamber from a source of said fuel and oil communicating with said chamber, and collecting said mixture of fuel and oil entrained within said chamber through said interconnecting passage in said rod adjacent said scoop means, said passage means communicating between said longitudinally extending bore in said rod and said chamber, said fuel and oil enters said bore in said rod through said angled passage means and exits through a-crankpin rod bearing and a wrist pin rod bearing as said rod reciprocates with said piston and rotates around said crankshaft through said crankpin, said fuel and oil thereby lubricating said bearings and cooling said rod as said engine operates.

10. The method as set forth in claim 9 further comprising the step of forming a second passage means adjacent a second scoop means formed in said rod, said second passage means being oriented substantially parallel, in a first plane, to an axis of said crankshaft, said second passage means forming a first inlet end and a second exit end, said second exit end being inside said rod adjacent a wall of said bore, said second passage means being angled, in a second plane, said second passage means being directed toward the other of said ends of said rod.

11. The method as set forth in claim 9 further comprising the steps of:

forming a pair of passage means in opposite, first and second faces of said rod, said pairs of passage means being oriented in a first plane, substantially parallel to an axis of said crankpin or wrist pin, forming a first pair of passage means in said first face of said rod, said rod forming first inlet openings and second exit openings, said second exit openings being formed in a wall of said longitudinal bore formed in said rod, one of said passage means is angled, in a second plane, toward said crankpin, the other of said passage means is angled, in said second plane, toward said wrist pin, a second pair of passage means, substantially identical to said first pair of passage means, is formed in said second face of said rod, and forming scoop means in said rod adjacent inlet openingsformed in said rod for said first and second pairs of passage means formed in said rod through said first and second faces of said rod, said scoop means serves to collect and direct said mixture of fuel and oil through said pairs of passage means into said bore formed in said rod.

12. The method as set forth in claim 11 wherein said scoop means is a shelf formed in said rod, said shelf cooperates with said inlet openings to said pairs of passage means to collect and direct said fuel and oil into said passage means.

13. The method as set forth in claim 12 wherein said shelf forms part of said inlet opening to said pairs of passage means in opposite faces of said rod.

14. The method as set forth in claim 9 wherein the angle of said passage means in said second plane is between fifteen and forty-five degrees with respect to an axis of said crankpin or wrist pin.

15. The method as set forth in claim 14 wherein the angle of said passage means in said second plane is about thirty degrees with respect to an axis of said crankpin or wrist pin.

* * * * *